United States Patent [19]

Snyder

[11] Patent Number: 4,665,756

[45] Date of Patent: May 19, 1987

[54] TORQUE TOOL

[75] Inventor: Robert F. Snyder, Hamden, Conn.

[73] Assignee: Raymond Engineering Inc., Middletown, Conn.

[21] Appl. No.: 752,255

[22] Filed: Jul. 3, 1985

[51] Int. Cl.[4] ..... B25B 23/142

[52] U.S. Cl. ..... 73/862.21; 73/862.31

[58] Field of Search ..... 73/862.21, 862.26, 862.31

[56] References Cited

U.S. PATENT DOCUMENTS

| | | | |
|---|---|---|---|
| 3,564,955 | 2/1971 | Batchelder | 73/862.21 X |
| 3,683,686 | 8/1972 | Sergan | 73/862.31 X |
| 4,060,137 | 11/1977 | Bickford et al. | 73/862.31 X |
| 4,213,333 | 7/1980 | Krieger et al. | 73/862.31 |
| 4,549,438 | 10/1985 | Grabovac et al. | 73/862.31 X |

*Primary Examiner*—Charles A. Ruehl

*Attorney, Agent, or Firm*—Fishman & Dionne

[57] ABSTRACT

A combined torque wrench and geared wrench which includes a ratchet mechanism, so that it can be operated in either a clockwise or a counter-clockwise output direction and so that a nut can be run down by ratcheting if necessary (due to space limitation) or desireable. The body of the wrench is relatively small so it can be operated by hand for quick run down. Provision is made for incorporation of an elongated handle which can be used for quick run down, pre-torquing, and/or a reaction bar. The wrench also incorporates a gear train for torque multiplication, and the gear train can be crank actuated by either of two inputs which are accessible at opposite sides of the body of the wrench, thus making the wrench accessible for crank input even though one side may be in quarters which are too close for use of the crank. The two inputs on opposite sides of the wrench also serves the purpose of allowing drive input on the side opposed to the side which must be supported against a reaction surface. The wrench of the present invention also incorporates an accurate torque readout mechanism so that the load can be accurately determined at all times. The torque readout mechanism may be either a hydraulically operated bellows and gage, or a mechanical readout system, or a strain gage or an electrical or electro-optical or other readout system.

41 Claims, 9 Drawing Figures

TORQUE TOOL

BACKGROUND OF THE INVENTION

This invention relates to the field of torquing tools. More particularly, this invention relates to a combined torque wrench and geared wrench.

Both geared wrenches and torque wrenches are well known in the art. These wrenches each have well known characteristics, advantages and disadvantages. While geared wrenches have a number of important advantages over wrenches such as impact wrenches and hand wrenches, geared wrenches are often compared unfavorably to impact wrenches and hand wrenches because the geared wrenches are considered to be too slow in initial stages of operation. That is, geared wrenches can not be used to quickly run nuts down, and a development of initial torque requires a large number of rotations of the hand crank. Torque wrenches, on the other hand, are compared unfavorably to geared wrenches because they are less accurate, they are awkward to use because they require long handles to generate high torque, and they cannot be operated in confined spaces because of insufficient room to swing the handle.

SUMMARY OF THE INVENTION

The present invention provides a unitary torque wrench and mechanical wrench which combines many of the advantageous features of both wrenches while eliminating or reducing many of the deficiencies discussed above. The wrench of the present invention can be used as a torque wrench for rapid run down of nuts and to apply modest setting or breakaway torques. Also, the bolting tool of the present invention can be used to apply high (i.e., multiplied) torques to the fasteners after they have been run down. And, the torquing tool of the present invention can perform all of its functions without the special adapters required for other geared wrenches and most multipliers.

The wrench of the present invention includes a ratchet mechanism, so that it can be operated in either a clockwise or a counter-clockwise output direction and so that a nut can be run down by ratcheting if necessary (due to space limitation) or desireable. The body of the wrench is relatively small (on the order of 7 inches long and 2½ inches wide), so it can be operated by hand for quick run down. Provision is made for incorporation of a elongated handle which can be used for quick run down, pre-torquing, and/or a reaction bar. The wrenche also incorporates a gear train for torque multiplication, and the gear train can be crank actuated by either of two inputs which are accessible at opposite sides of the body of the wrench, thus making the wrench accessible for crank input even though one side may be in quarters which are too close for use of the crank. The two inputs on opposite sides of the wrench also serves the important purpose of allowing drive input on the side opposed to the side which must be supported against a reaction surface. The wrench of the present invention also incorporates an accurate torque readout mechanism so that the load can be accurately determined at all times. The torque readout mechanism may be either a hydraulically operated bellows and gage, or a mechanical readout system, or a strain gage or an electrical or electro-optical or other readout system.

The above discussed and other features and advantages of the present invention will be apparent to and understood by those skilled in the art from the following detailed description and drawings.

BRIEF DESCRIPTION OF THE DRAWINGS

Referring now to the several figures of the drawings, wherein like elements are numbered alike in the several figures.

DESCRIPTION OF THE PREFERRED EMBODIMENT

Figure 1:
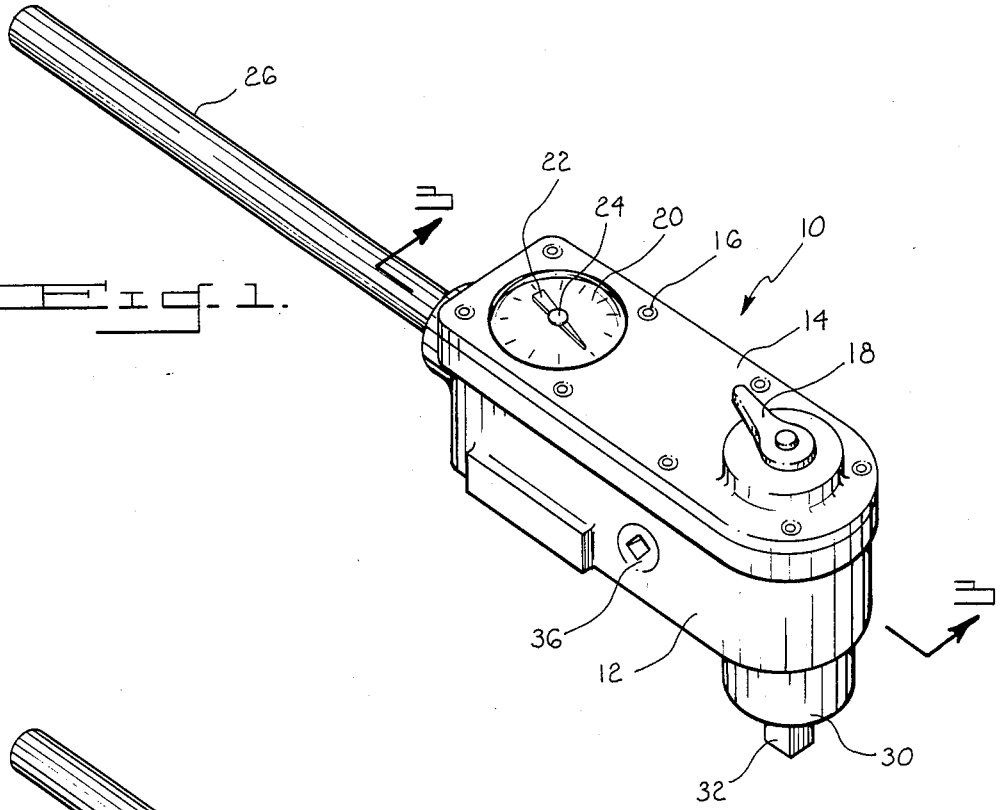
FIG. 1 is a top perspective view of the wrench of the present invention.
Figure 2:
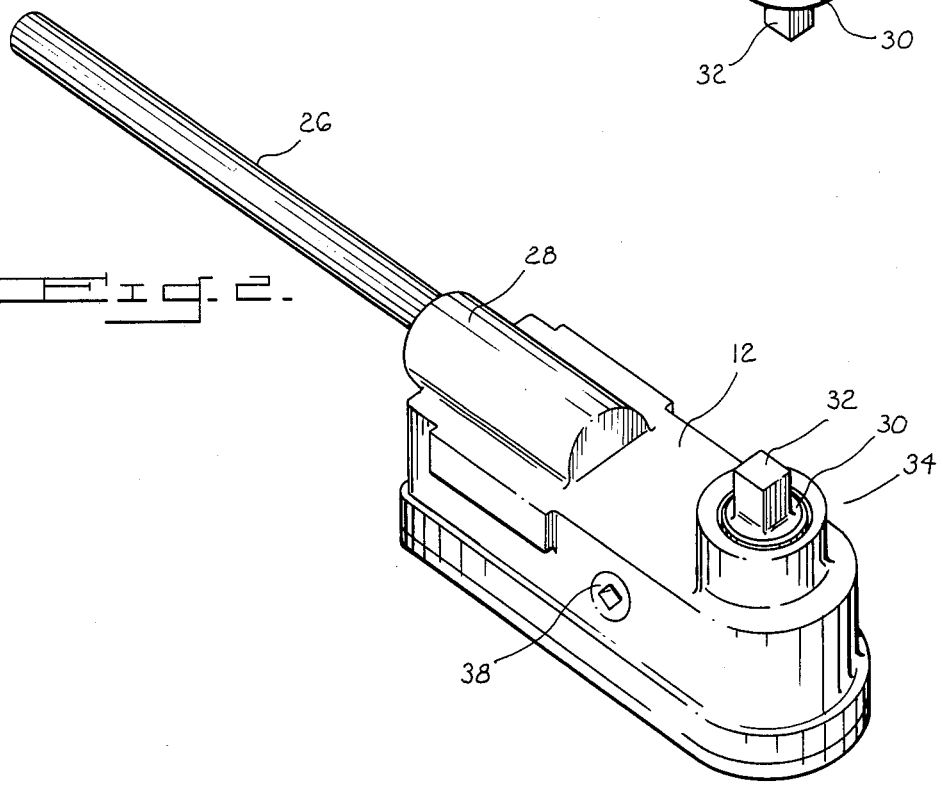
FIG. 2 is a bottom perspective view of the wrench of the present invention.

Referring first to FIGS. 1 and 2, the torquing tool of the present invention is indicated generally at 10 and has a main body casting 12 with a cover plate 14 releasably fastened to the main body by a series of fasteners 16. A ratchet selector 18 is rotatably mounted on cover 14, and cover 14 contains a torque load indicator which includes dial 20 and an indicator 22 fixed to rotatably indicator shaft 24. An elongated detachable handle 26 extends from one end of the tool, the handle 26 being releasably received in a housing channel 28 by either a snap action ball detent mechanism (as shown) or by a screw thread connection. At the end of the housing removed from handle 26 there is a downwardly depending housing section 29 which houses the ratchet mechanism, and a rotatable drive bar 32 extends from housing section 29. Input drives 36 and 38 to a worm gear within main body 12 are located at opposite sides of main body housing 12, each of the input drive units having a square socket to receive the tip of a drive crank.

Figure 3:
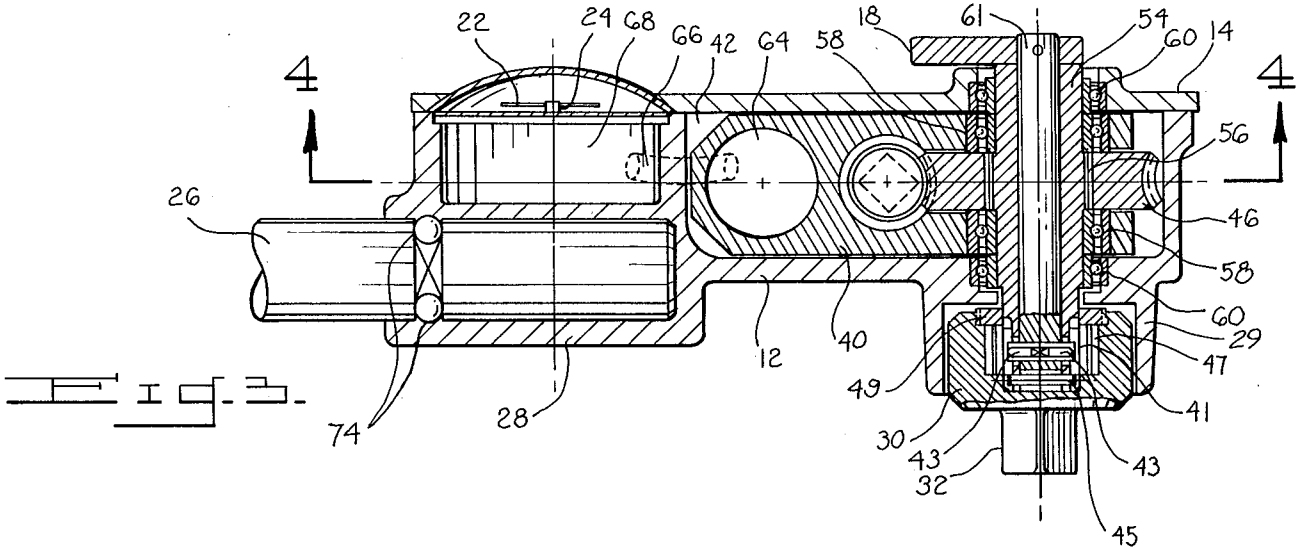
FIG. 3 is a sectional elevational view taken along line 3—3 of FIG. 1.
Figure 4:
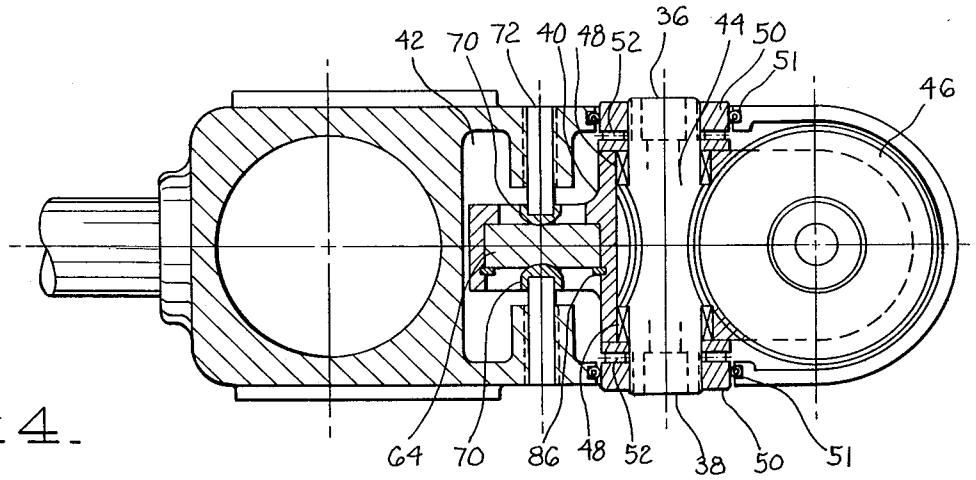
FIG. 4 is a plan sectional view taken along line 4—4 of FIG. 3.

Referring now to FIGS. 3 and 4, the internal structure of the tool is shown. A carrier element 40 is positioned within a main body cavity 42 in the tool. Carrier 40 carries a worm 44 (which has inputs 36 and 38 at opposites ends thereof), and carrier 40 also carries a worm gear 46 which meshes with and is driven by worm 44. Worm 44 and worm gear 46 are designed so that they form a self locking combination for inputs (from either side) of up to 300 foot-pounds. Worm 44 is rotatably supported on radial needle bearings 48, and each end of worm 44 is capped by a thrust nut 50 which is threadably fastened to the end of the worm about the input drive opening and which is rotatably supported on thrust roller bearings 52. Thrust nuts 50 are sealed against oil leakage by seals 51. However, seals 51 are not "O" ring seals; they are hollow continuous tubes of elastomeric material. The fact that the tubes 51 are hollow permits them to compress when the gear and carrier section is under reaction load.

Gear 46 is splined to an output shaft 54 by a splined connection 56. Output shaft 54 is rotatably supported in the housing by radial/thrust bearings 58 and 60. Drive bar 32 is connected to output shaft 54 through the ratchet mechanism. A ratchet selector shaft 61 passes through a central axial opening in output shaft 54 and is connected to the selector portion of the ratchet mechanism to select either clock-wise or counter clock-wise operation of the ratchet, depending on the position of selector lever 18. The ratchet mechanism includes pawls 41 and spring loaded pawl operators 43 which are retained in an opening in the selector shaft 61. The pawls are retained by a pin 45 through ratchet selector shaft 61. The ratchet pawls mate with a gear 47 on the interior of housing 30 to drive housing 30 and output bar 32 with output shaft 54. Housing 30 is retained in position by a spanner nut 49 which is threadably connected on its exterior to the interior of housing 30. Spanner nut 49 sits on top of pawls 41 to be retained in the assembly. Of course, the ratchet mechanism may be any suitable standard ratchet mechanism known in the art.

Carrier element 40 also houses a bellows 64 which is filled with hydraulic fluid and is connected via a hydraulic line 66 to gage 68. Bellows 64, hydraulic line 66 and gage 68 function as described in U.S. Pat. No. 3,683,686 (assigned to the assignee hereof and the contents of which are incorporated by reference) to provide a hydraulic measuring system to measure the torque of the wrench. Indicator shaft 24 is connected to gage 68 so that the position of indicator 22 is commensurate with the torque load. The torque load is imposed on bellows 64 by a pair of load buttons 70 which sit in mating depressions on opposite sides of bellows 64. Each of the buttons 70 is at the end of an adjustable screw 72 whereby the bellows may be calibrated or preloaded.

Load buttons 70 are constructed and operate as described in U.S. patent application Ser. No. 604,171, now U.S. Pat. No. 4,577,912, assigned to the assignee hereof and incorporated herein by reference.

As best shown in FIG. 3, handle 26 is removably retained in housing channel or sleeve 28, by a pair of spring loaded balls 74 in the handle 26 which seat in detents in the housing. The handle may also threadably engage the housing.

Figure 5:
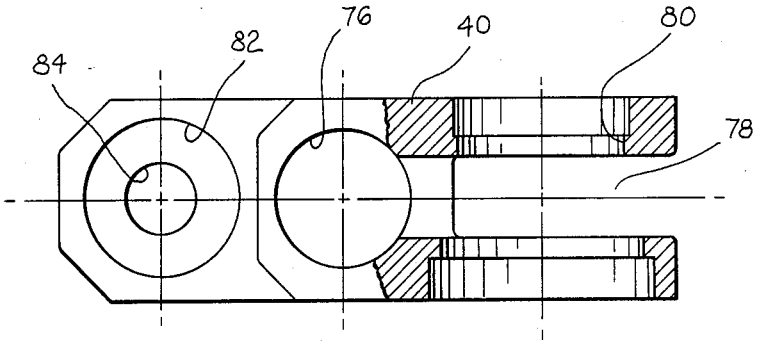
FIG. 5 is a view, partly in section, of the gear carrier structure for the hydraulic readout embodiment of the present invention.
Figure 6:
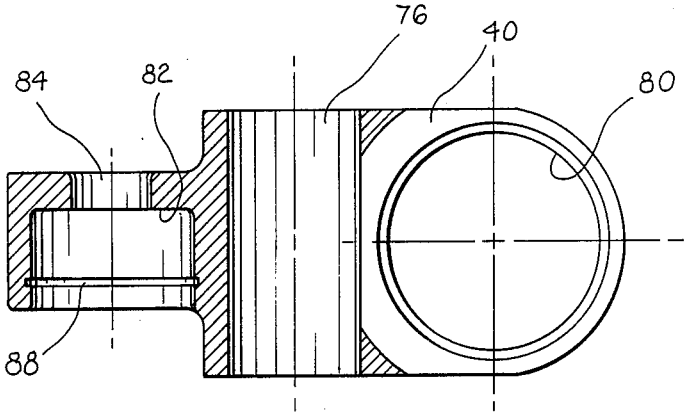
FIG. 6 is a top plan view of the gear carrier of FIG. 5.

Carrier element 40 is shown in detail in FIGS. 5 and 6. As can best be seen in these figures, worm 44 is housed in an opening 76; worm gear 46 is housed in an opening 78; and output shaft 54 is housed in an opening 80. Also, the details of the retention of bellows 64 can be seen whereby the bellows is housed in a recess 82 and one of the load buttons 70 contacts the bellows through opening 84. The bellows is retained in recess 82 by a snap ring 86 (see FIG. 4) which is seated in retaining groove 88.

In the operation of the system described in FIGS. 1 through 6, the direction of the operation of the wrench is selected by positioning ratchet lever 18 to select either counter clock-wise or clock-wise operation. Drive bar 32 is then affixed to a socket which is mounted on a nut to be tightened. With handle 26 removed, the wrench may be manually operated in an oscillating action to quickly run down the nut. When the nut has been fully run down, the wrench may then be operated as a torque wrench by mounting handle 26 in place and using handle 26 as a lever arm to apply a torque load to the nut. If a higher torque load is desired than can be obtained with handle 26, a crank can be applied to input drive 36 or input drive 38 to provide torque multiplication through the gear train to torque the nut to the desired torque level. During all stages of the operation after the nut has been run down, the readout system will provide an accurate instantaneous indication of the torque load. The torque load results in imposition of an equal and opposite reaction on worm 44 and on carrier 40, whereby carrier 40 and worm 44 pivot slightly relative to housing 12 about the axis of output shaft 54; and this pivoting action results in a load being imposed on the bellows 64 through one or the other load buttons 70. This load on the bellows is transmitted by hydraulic line 66 to gage 68 where it is then read out by means of indicator 22 and dial 23. Since worm 44 pivots slightly, a drag load would be imposed on thrust nuts 50 during the input driving of worm 44 if seals 51 were solid "O" rings. However, since seals 51 are hollow tubes, they can collapse and still perform their sealing function without imposing a drag load on the input drive.

Figure 7:
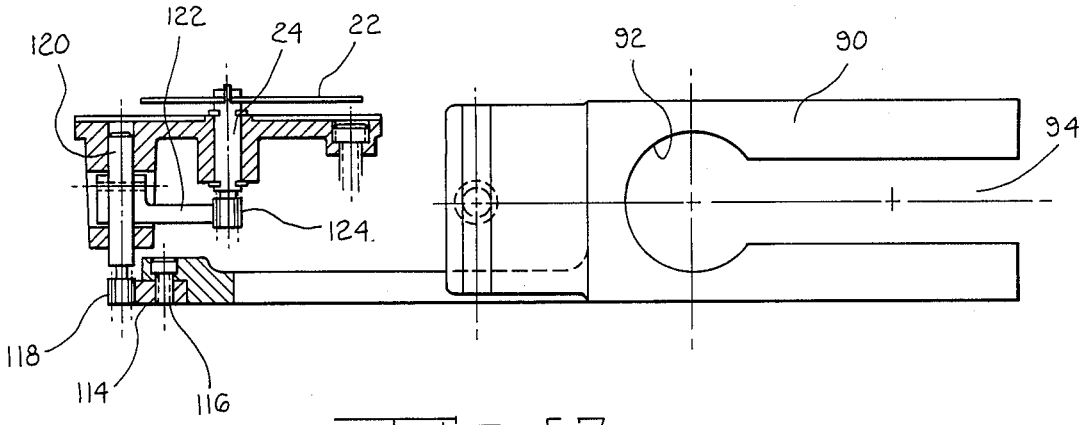
FIG. 7 is a side elevation view, partly in section, of the gear carrier and readout structure for the mechanical readout embodiment of the present invention.
Figure 8:
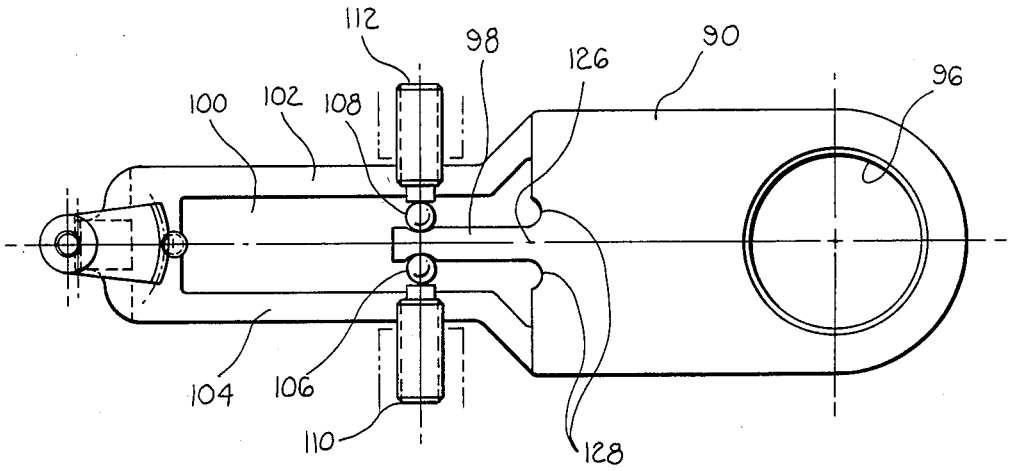
FIG. 8 is a top plan view of the structure of FIG. 7, with dial readout mechanism removed for clarity.

Referring now to FIGS. 7 and 8, an embodiment of the present invention is shown incorporating a mechanical torque sensing and readout system. For the mechanical sensing and read out system, the main structure of the wrench, including the wrench body and the worm and gear drive, the ratchet assembly and output mechanism are essentially the same as for the embodiment previously discussed. The difference between the embodiments resides in the structure shown in FIGS. 7 and 8, the principal differences being in the carrier element, and in the load sensing and readout structure. In the embodiment of FIGS. 7 and 8, the carrier 90 has an opening 92 to receive the worm gear 44 and an opening 94 to receive the gear 46, and an opening 96 to receive the output shaft 54. A cantilevered beam 98 extends from the body of carrier 90 along the axis of longitudinal symmetry of the carrier body and extends into a cavity 100 between legs 102 and 104 extending from the main body of the carrier. A pair of load balls 106 and 108 are held against opposite sides of beam 98 adjacent the free end thereof and at the midpoint of the height thereof. Balls 106 and 108 seat in corresponding recesses in beam 98. Balls 106 and 108 are loaded against beam 98 by load screws 110 and 112 which, like screws 72 are threadable engaged in main body housing 12, whereby the balls are firmly loaded against beam 98 and may be adjusted for calibration or preloading purposes.

A segment of a gear rack 114 is connected by a fastener 116 to the far end of carrier 90, i.e. the end removed from output shaft opening 96. Rack 114 is connected to drive a pinion 118 which, in turn, is fixed to the end of a rotatable shaft 120, whereby shaft 120 rotates with gear 118. A segment of a spur gear 122 is also fixed to shaft 120, whereby the spur gear segment 122 also rotates with shaft 120. Spur gear 122 meshes with and drives a pinion 124 which is fixed to indicator shaft 24, which, in turn, is fixed to indicator 22.

In the mechanical sensing and readout embodiment of the wrench, whenever a load is imposed on output shaft 54, an equal and opposite load is imposed on carrier 90. Since beam 98 is fixed between load balls 106 and 108, a flexing of the carrier beam 98 will occur at the root end 126 of the beam to cause a slight arcuate motion at the end of the carrier at which rack 114 is mounted. The arcuate motion of rack 114 rotates pinion 118 and shaft 120, whereby gear 122 is rotated to drive pinion 124 and indicator shaft 24 to cause indicator 22 to move. The motion imparted to rack 114 is proportional to the reaction load on carrier 90, and hence proportional to the torque load, and thus the movement and position of indicator 22 is commensurate with and provides a reading of the torque load on the system.

It is important to note that the mechanical readout system of the present invention has the capability of continuous rotary motion of the wrench for torque loading with continuous readout with a beam system. The beam system is not, as is typical in the prior art, limited to small arcs of travel.

The root end 126 of the cantilever beam is provided with stress reliefs 128, both to avoid stress concentrations and facilitate flexing when torque loads are imposed on the system.

Figure 9:
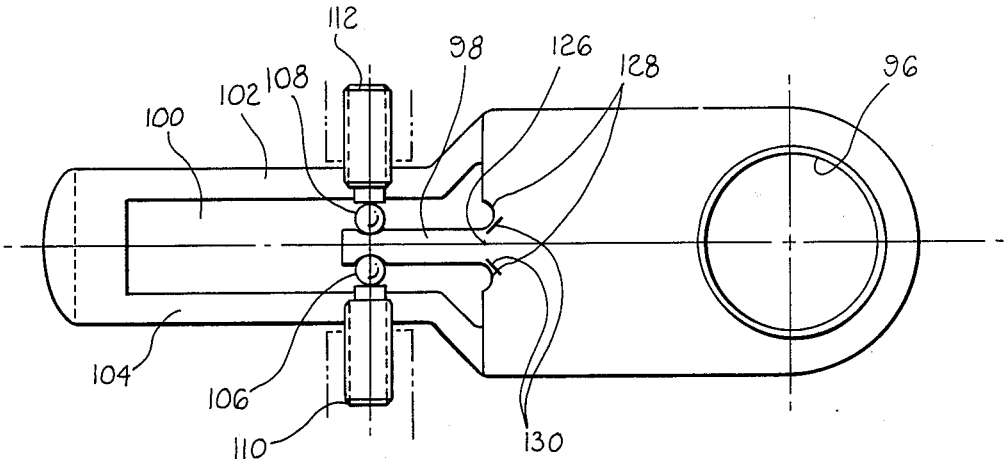
FIG. 9 is a top plan view of the wrench, similar to FIG. 8, with the incorporation of strain gage elements.

Referring now to FIG. 9, a modification of the structure of FIGS. 7 and 8 is shown to achieve an electronic readout system. In the embodiment of FIG. 9, strain gage elements 130 are mounted at the root end of beam 98 in the vicinity of stress relief 128. The strain gage elements 130 are mounted at the sites of highest stress concentration when beam 98 is flexed. The output from strain gages 130 are fed to a suitable meter or other detector, and the output can be displayed at a display in the position of dial 20.

From the foregoing, it can be seen that the bolting tool of the present invention can be used as a manually operated wrench or as a torque wrench with ratchet head and accurate readout for rapid run down of nuts and to apply modest seating or breakaway torques. During such operations, an accurate readout of the torque load will always be readily available. The tool of the present invention can also be used to apply high or "mulitiplied" torque loads to the fasteners which have been rapidly run down in the manual or torque wrench mode. All of the foregoing can be accomplished with the tool of the present invention without special adaptors usually required for geared wrenches or multipliers.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A torquing device for applying torque to a fastening element, the torquing device comprising:

a main body having first and second ends, said main body having a main body cavity therein;

ratchet means, said ratchet mens facilitating quick run-down of the element to be fastened and including a ratchet selector rotatably mounted exterior of said main body;

gear train means in said main body cavity for torque multiplication, said gear train means having at least one input means thereto, said input means communicating between said gear train means and the exterior of said main body;

a rotatable output shaft rotatably supporting in said main body cavity and connected to said gear train means, said output shaft being connected through said ratchet means to a rotatable drive bar which extends from said main body cavity to said body exterior adjacent a first end thereof, said output shaft being connected to said ratchet means whereby said ratchet selector can select either clockwise or counter-clockwise rotation of said drive bar;

torque measuring means disposed in said body cavity and adapted to measure the torque on said output shaft;

torque load indicating means being connected to said torque measuring means; and unitary internal carrier support means disposed in said body cavity, said carrier support means supporting said gear train means and said torque measuring means.

2. The device of claim 1 wherein said gear train means comprises:

a first gear means terminating at said input means, said first gear means being rotatably supported on first bearing means;

second gear means which meshes with and is driven by said first gear means, said second gear means being connected to said output shaft wherein said second gear means drives said output shaft.

3. The device of claim 2 wherein:

said first gear means comprises a worm; and said second gear means comprises a worm gear.

4. The device of claim 3 wherein:

said worm includes opposed ends, said ends being capped by thrust nut means, said thrust nut means surrounding said at least one input means.

5. The device of claim 4 wherein:

said ends of said worm are rotatably supported on thrust roller bearings.

6. The device of claim 4 wherein:

said thrust nut means are sealed by seal means.

7. The device of claim 6 wherein:

said seal means comprise hollow continuous tubes of elastomeric material.

8. The device of claim 2 wherein:

said first and second gear means form a self-locking combination for inputs of up to 300 foot-pounds.

9. The device of claim 2 wherein:

said first bearing means comprises a radial needle bearings.

10. The device of claim 2 wherein said at least one input means includes:

two oppositely disposed input means communicating with said first gear means.

11. The device of claim 2 wherein:

said second gear means is splined to said output shaft.

12. The device of claim 1 wherein said at least one input means includes:

two opposite disposed input means terminating exterior of said housing.

13. The device of claim 1 including:

elongated handle means extending from said second end of said main body, said second end being opposite from said first end of said main body adjacent which said rotatable drive bars extends.

14. The device of claim 13 wherein said elongated handle means is detachably connected to said main body.

15. The device of claim 14 wherein:

said main body includes a depending housing section; and wherein;

said drive bar extends from said depending housing section.

16. The device of claim 1 wherein said main body has first and second opposed surfaces and wherein said ratchet selector is rotatably mounted on said first surface and said drive bar is mounted on said second surface.

17. The device of claim 16 including:

releasably fastened cover plate means on said main body first surface.

18. The device of claim 1 wherein:

said rotatable output shaft is rotatably supported in said body cavity by radial/thrust bearing means.

19. The device of claim 1 wherein said torque measuring means comprises hydraulic torque measuring means.

20. The device of claim 19 wherein said hydraulic torque measuring means includes:

a bellows having a hydraulic fluid therein;

said torque load indicating means being connected to said bellows through a hydraulic fluid line;

a pair of load buttons disposed in mating depressions on opposite sides of said bellows; and adjustable screw means abuting each of said load buttons whereby said bellows may be calibrated or preloaded.

21. The device of claim 20 wherein said torque load indicating means comprises:

gage means; and an indicator shaft connected to said gage means.

22. The device of claim 1 wherein said torque measuring means comprises mechanical or strain gage torque measuring means.

23. The device of claim 22 wherein said mechanical or strain gage torque measuring means includes:

a cantilevered beam extending from said carrier support means;

a pair of load balls disposed in mating depressions on opposite sides of said cantilevered beam; and adjustable screw means abutting each of said load balls for calibration or preloading.

24. The device of claim 23 wherein:

said internal carrier support means has an opening therethrough defining a pair of oppositely disposed arms; and wherein said cantilevered beam extends from said carrier support means into said opening between said arms.

25. The device of claim 23 wherein said torque load indicating means comprises:

a rack mounted on an extension from said carrier support means;

first pinion means driven by said rack;

a shaft connected to said first pinion means;

a gear segment connected to said shaft;

second pinion means connected to said gear segment; and output indicator means connected to said second pinion means.

26. The device of claim 25 wherein said output indicator means comprises:

an indicator shaft connected to said second pinion means; and an indicator connected to said indicator shaft.

27. The device of claim 23 wherein:

said beam has a root end which is connected to said carrier support means; and including:

strain gage elements mounted adjacent said root end.

28. The device of claim 23 wherein:

said beam has a root end which is connected to said carrier support means; and including:

stress relief means in said carrier support means adjacent said root end.

29. A combined manual torque wrench and torque multiplier gear wrench comprising:

an elongated main body having first and second opposed ends, said main body having a main body cavity therein;

unitary internal carrier support means disposed in said main body cavity;

gear train means for torque multiplication, said gear train mens being in said carrier support means in said main body cavity;

first and second input means on opposed sides of said main body for delivering input to said gear train means;

rotatable output shaft means supported in said carrier support means adjacent a first end of said main body, said output shaft means being connected to said gear train means;

two-directional ratchet means connected to said output shaft means, said ratchet means enabling multiple stroke quick run down of an element to be fastened, and including directional selector means exterior of said main body;

rotatable drive bar means connected to said ratchet means, whereby said ratchet selector can select either clockwise or counterclockwise rotation of said drive bar;

torque measuring means for measuring the torque level, said torque measuring means being supported on said carrier support means; and torque indicating means connected to said torque measuring means to display torque level.

30. The wrench of claim 29 wherein said carrier support means includes:

first and second sections extending in mutually perpendicular directions;

said gear train means being supported in one of said sections, and said torque measuring means being supported in the other of said sections.

31. The wrench of claim 29 including:

elongated bar means connectable to the second end of said main body, said bar means being capable of serving as an input to asid wrench or as a reaction element.

32. A torquing device for applying torque to a fastening element, the torquing device comprising:

a main body having first and second ends, said main body having a main body cavity therein;

ratchet means, said ratchet means facilitating quick run-down of the element to be fastened and including a ratchet selector rotatably mounted exterior of said main body;

gear train means in said main body cavity for torque multiplication, said gear train means having at least one input means thereto, said input means communicating between said gear train means and the exterior of said main body;

a rotatable output shaft rotatably supported in said main body cavity and connected to said gear train means, said output shaft being connected through said ratchet means to a rotatable drive bar which extends from said main body cavity to said body exterior adjacent a first end thereof, said output shaft being connected to said ratchet means whereby said ratchet selector can select either clockwise or counter-clockwise rotation of said drive bar;

torque measuring means disposed in said body cavity and adapted to measure the torque on said output shaft;

torque load indicating means being connected to said torque measuring means;

internal carrier support means disposed in said body cavity, said carrier support means supporting said gear train means and said torque measuring means;

wherein said gear train means comprises:

a worm means terminating at said input means, said worm means being rotatably supported on first bearing means;

worm gear means which meshes with and is driven by said worm means, said worm gear means being connected to said output shaft wherein said worm gear means drives said output shaft; and wherein said worm means includes opposed ends, said ends being capped by thrust nut means, said thrust nut means surrounding said at least one input means.

33. The device of claim 32 wherein:

said ends of said worm are rotatably supported on thrust roller bearings.

34. The device of claim 32 wherein:

said thrust nut means are sealed by seal means.

35. The device of claim 34 wherein:

said seal means comprise hollow continuous tubes of elastomeric material.

36. A torquing device for applying torque to a fastening element, the torquing device comprising:

a main body having first and second ends, said main body having a main body cavity therein;

ratchet means, said ratchet means facilitating quick run-down of the element to be fastened and including a ratchet selector rotatabLy mounted exterior of said main body;

gear train means in said main body cavity for torque multiplication, said gear train means having at least one input means thereto, said input means communicating between said gear train means and the exterior of said main body;

a rotatable output shaft rotatably supported in said main body cavity and connected to said gear train means, said output shaft being connected through said ratchet means to a rotatable drive bar which extends from said main body cavity to said body exterior adjacent a first end thereof, said output shaft being connected to said ratchet means whereby said ratchet selector can select either clockwise or counter-clockwise rotation of said drive bar;

mechanical or strain gage torque measuring means disposed in said body cavity and adapted to measure the torque on said output shaft;

torque load indicating means being connected to said torque measuring means;

internal carrier support means disposed in said body cavity, said carrier support means supporting said gear train means and said torque measuring means;

said mechanical or strain gage torque measuring means includes;

a cantilevered beam extending from said carrier support means;

a pair of load balls disposed in mating depressions on opposite sides of said cantilevered beam; and adjustable screw means abutting each of said load balls for calibration or preloading.

37. The device of claim 36 wherein:

said internal carrier support means has an opening therethrough defining a pair of oppositely disposed arms; and wherein said cantilevered beam extends from said carrier support means into said opening between said arms.

38. The device of claim 36 wherein said torque load indicating means comprises:

a rack mounted on an extension from said carrier support means;

first pinion means driven by said rack;

a shaft connected to said first pinion means;

a gear segment connected to said shaft;

second pinion means connected to said gear segments; and output indicator means connected to said second pinion means.

39. The device of claim 38 wherein said output indicator means comprises:

an indicator shaft connected to said second pinion means; and an indicator connected to said indicator shaft.

40. The device of claim 36 wherein:

said beam has a root end which is connected to said carrier support means; and including:

strain gage elements mounted adjacent said root end.

41. The device of claim 36 wherein:

said beam has a root end which is connected to said carrier support means; and including:

stress relief means in said carrier support means adjacent said root end.

* * * * *